US007171851B2

(12) United States Patent
Kamata

(10) Patent No.: US 7,171,851 B2
(45) Date of Patent: Feb. 6, 2007

(54) TEMPERATURE COMPENSATED STRAIN MEASUREMENT

(75) Inventor: Masahiro Kamata, Kawasaki (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/023,848

(22) Filed: Dec. 28, 2004

(65) Prior Publication Data

US 2006/0137442 A1 Jun. 29, 2006

(51) Int. Cl.
*E21B 47/00* (2006.01)

(52) U.S. Cl. ..... 73/152.59; 73/152.48; 73/152.49

(58) Field of Classification Search ..... 73/152.48, 73/152.49

See application file for complete search history.

(56) References Cited

U.S. PATENT DOCUMENTS 3,635,076 A 1/1972 Sacks et al.
4,543,832 A * 10/1985 Van Over ..... 73/720
5,739,435 A 4/1998 Sacks et al.
5,900,545 A * 5/1999 Sacks et al. ..... 73/152.52

FOREIGN PATENT DOCUMENTS

| | | |
|---|---|---|
| CH | 335564 | 1/1959 |
| GB | 1 201 055 | 8/1970 |
| JP | 57-165710 | 1/1983 |
| WO | WO 1997/15804 | 5/1997 |

* cited by examiner

*Primary Examiner*—Hezron Williams
*Assistant Examiner*—Paul M. West
(74) *Attorney, Agent, or Firm*—Karan Singh; William Batzer; Dale Gaudier

(57) ABSTRACT

The present invention provides methods and apparatus for measuring subterranean strain. The methods and apparatus use fluid expansion principles to compensate for temperature variations and increase the accuracy of the strain measurements. The methods and apparatus contemplate the use of multiple fluid chambers according to some embodiments in order to remove temperature dependence from stress or strain measurements.

39 Claims, 5 Drawing Sheets

TEMPERATURE COMPENSATED STRAIN MEASUREMENT

FIELD OF THE INVENTION

The present invention relates generally to methods and systems for monitoring subterranean parameters. More particularly, this invention is directed to methods and systems for monitoring strain in the earth interior.

BACKGROUND OF THE INVENTION

Volumetric strainmeters are often used to monitor changes in strain in the earth's interior. Volumetric strainmeters are considered to be the most sensitive of sensors used to measure small changes in subterranean stress or strain. A typical strainmeter 100 shown in FIG. 1 may be inserted into a subterranean formation to monitor tectonic stress. The strainmeter 100 includes a housing 102 enclosing a chamber 104 filled with a fluid, a capillary tube 106, and a differential transformer 108 connected to the capillary tube 106. The capillary tube 104 is in fluid communication with the chamber 104. The differential transformer 108 measures the volume of fluid that comes out of or is displaced from the chamber 104 when tectonic stress compresses and deforms the chamber 104.

However, if the volume of fluid displaced from the chamber 104 exceeds the capacity of the differential transformer 108, a quantum-metered overcapacity relief valve 110 in fluid communication with the chamber 104 opens and allows fluid flow from the chamber 104 into an overcapacity chamber 112 filled with Argon gas. The volume of fluid that may enter the overcapacity chamber 112 is constant or quantized, and the strainmeter counts and records the number of times an overcapacity condition occurs. Therefore, the total amount of fluid displaced from the chamber 104 into the overcapacity chamber 112 is readily determined.

The fluid volume V of the chamber 104 is expressed as:

$$V = \frac{\pi D^2 L}{4} \tag{1}$$

where:

D is the internal diameter of the chamber; and

L is the internal length of the chamber.

The volumetric change ΔV is therefore:

$$\Delta V = \frac{\pi L}{4}(D_2^2 - D_1^2) \tag{2}$$

for a diameter change from $D_1$ to $D_2$ due to strain. Accordingly, the sensitivity of the strainmeter 100 is governed by its diameter and length, and strain can be determined by measuring the volume of fluid displaced from the chamber 104.

The fluid in the chamber 104 is often silicon oil. The thermal expansion coefficient α of silicon oil is approximately $9.5\times10^{-4}$. Therefore, strain due to changes in temperature is:

$$\frac{\Delta V}{V} = \alpha \Delta T \ (^\circ C.) \tag{3}$$

However, to measure volumetric strain on the order of $10^{-12}$ (the resolution commonly sought for subterranean oilfield applications) the required stability of the temperature should be less than:

$$\Delta T = \frac{10^{-12}}{9.5\times10^{-4}} \cong 10^{-9} \ (^\circ C.) \tag{4}$$

It may be difficult or impossible to maintain temperature stability to $10^{-9}$ (° C.), and it may not even be possible to verify that the temperature at the strainmeter is within such an order. Therefore, the strainmeter 100 may be equipped with a thermocouple 114 as shown in FIG. 1 to measure the fluid temperature and compensate for fluid thermal expansion due to temperature variations. The highest resolution currently available for temperature measurement is about 1/1000° C. This corresponds to a strain resolution on the order of $10^{-6}$. However, for long term subterranean monitoring, the best resolution available for temperature measurement is about 1/100° C. and many orders of magnitude too low to provide strain measurement on the order of $10^{-9}$.

Moreover, even if temperature could be measured with enough accuracy to compensate for thermal fluid expansion for strain measurements on the order of $10^{-9}$, the thermocouple 114 only measures the temperature of the fluid locally. Temperature may be distributed throughout the chamber 104 while and the measured temperature is the temperature at the thermocouple. Thermal expansion of the fluid represents the true average temperature throughout the chamber 104 or the integration of thermal expansion in the whole fluid volume. Accordingly, it is important to reduce temperature sensitivity of volumetric strainmeters and further separate temperature dependency from stress changes.

The present invention is direct to overcoming, or at least reducing the effects of, one or more of the problems presented above.

SUMMARY OF THE INVENTION

The present invention meets the above-described needs and others. Specifically, the present invention provides methods and apparatus for monitoring subterranean parameters. The methods and apparatus measure subterranean stress or strain and compensate for temperature variations.

According to one aspect of the invention, there is a method of monitoring subterranean parameters comprising measuring strain changes in the earth using fluid expansion to compensate for temperature variations. The method may include measuring fluid volume change of a first fluid in response to tectonic stresses, the first fluid comprising a first thermal expansion coefficient; measuring fluid volume change of a second fluid having a second thermal expansion coefficient, the second thermal expansion coefficient being greater than the first thermal expansion coefficient; and compensating the fluid volume change measurement of the first fluid for temperature using the fluid volume change measurement of the second fluid. The second thermal expansion coefficient may be at least two to seven times greater than the first thermal expansion coefficient. The first fluid may be selected from the group consisting of: water, mercury, and glycerin; and the second fluid is selected from the group consisting of: alcohol, benzol, acetone, ether, and silicon oil. The fluid expansion is used to compensate for true average temperature variations, not only local temperature variation as done by prior art thermocouples.

According to some aspects, the method may comprise reducing a volume of a first fluid used to measure strain to less than a volume of a second fluid used to compensate for temperature. The reducing may include inserting a solid object with a small thermal expansion coefficient into a first fluid container.

According to some aspects, the method comprises providing a first fluid chamber sensitive to strain, the first fluid chamber comprising a first volume of fluid; providing a second fluid chamber insensitive to strain because the housing of the first chamber takes the stress by its deformation, the second fluid chamber comprising a second volume of fluid; measuring fluid displaced from the first fluid chamber in response to tectonic stress; measuring expansion of the second volume of fluid in response to temperature variations; and compensating measured fluid displaced from the first fluid chamber for temperature by the measured expansion of the second volume of fluid. The fluid in the first and second fluid chambers may the same or different. For example, the fluid in the first fluid chamber may have a lower thermal expansion coefficient than the fluid in the second fluid chamber.

According to some aspects, the method comprises providing a first fluid chamber of a first exterior size sensitive to strain and having a first volume of fluid filling the first chamber; providing a second fluid chamber of the first exterior size sensitive to strain having a second volume of fluid filling the second chamber, the second volume of fluid being less than the first volume of fluid; measuring displacement of the first volume of fluid from the first chamber in response to strain and in response to temperature changes; measuring displacement of the second volume of fluid from the second chamber in response to strain and in response to a fraction of the temperature changes; and compensating strain for temperature using the fractional displacement change due to temperature changes in the second chamber. The method may also include reducing the first volume of fluid by inserting a first object into the first chamber, and reducing the second volume of fluid by inserting a second object into the second chamber.

Another aspect of the method includes providing a first fluid chamber sensitive to tectonic stress having a first volume of fluid; providing a second fluid chamber concentric with the first fluid chamber having a second volume of fluid, the second fluid chamber being insensitive to tectonic stress; measuring displacement of the first volume of fluid from the first fluid chamber in response to strain and in response to temperature changes; measuring displacement of the second volume of fluid from the second fluid chamber in response to temperature changes; and compensating strain for temperature using the measured displacement of the second volume of fluid due to temperature changes. The first volume may be defined by an annulus between first and second chambers.

Another aspect of the invention provides a method of measuring subterranean strain. The method comprises filling a first chamber of a volumetric strainmeter with a first fluid; filling a second chamber of the volumetric strainmeter with a second fluid; measuring a volume of fluid displaced from the first chamber in response to tectonic stress; measuring fluid expansion of the second fluid due to temperature variations; and compensating the measurement of first fluid displaced from the first chamber for the temperature variations using the expansion measurements of the second fluid. The first chamber may comprise a strain-sensitive chamber, and the second chamber comprises a strain-insensitive chamber.

Another aspect of the invention provides another method of monitoring subterranean parameters. The method comprises measuring strain changes in the earth with a volumetric strainmeter, and compensating for temperature variations without a thermocouple. Compensating for temperature may include measuring fluid expansion of a separate fluid volume. Measuring strain changes may comprise measuring changes in volumetric fluid capacity of a first chamber containing a first fluid in response to tectonic stresses and temperature variations, the first fluid comprising a first thermal expansion coefficient; measuring changes in volumetric fluid capacity of a second chamber containing a second fluid in response to tectonic stresses and temperature variations, the second fluid comprising a second thermal expansion coefficient, the second thermal expansion coefficient being different than the first thermal expansion coefficient; and calculating volumetric strain independent of temperature. Measuring strain changes may also comprise measuring changes in volumetric fluid capacity of a first chamber containing a first fluid in response to tectonic stresses and temperature variations, the first chamber being sensitive to strain; measuring changes in volumetric fluid capacity of a second chamber containing a second fluid in response to temperature variations only, the second chamber being insensitive to strain; and calculating volumetric strain compensated for temperature by subtracting the measured changes in volumetric fluid capacity of the second chamber from the measured changes in volumetric fluid capacity of the first chamber.

Another aspect of the invention provides a volumetric strainmeter. The volumetric strainmeter comprises a housing, a strain measurement chamber filled with a first fluid, a temperature compensation chamber filled with a second fluid, a first fluid meter operatively connected to the strain measurement chamber for measuring fluid displaced from the strain measurement chamber, and a second fluid meter operatively connected to the temperature compensation chamber for measuring fluid displaced from the temperature compensation chamber. According to some embodiments, the strain measurement chamber deforms in response to tectonic stress, and the temperature compensation chamber does not deform in response to tectonic stress. The first and second fluids may comprise the same thermal expansion coefficient.

According to some embodiments of the strainmeter, however, the strain measurement chamber and the temperature compensation chamber deform substantially identically in response to tectonic stress, and the first and second fluids have different, known thermal expansion coefficients.

Some embodiments of the volumetric strainmeter include a solid object in one or both of the strain measurement chamber and the temperature compensation chamber, where a fluid annulus is defined between the solid object and the housing. In embodiments including a solid object in both the strain measurement chamber and the temperature compensation chamber, the diameters of the solid objects may be different.

According to some embodiments of the volumetric strainmeter, the temperature compensation chamber is concentric with the strain measurement chamber. The temperature compensation chamber may be arranged inside the housing, and the strain measurement chamber may comprise an annulus between the housing and the temperature compensation chamber. The strain measurement chamber may also be partitioned to measure direction of tectonic stress. The strainmeter may also include a plurality of thermal conduction fins extending from the temperature compensation chamber to the strain measurement chamber.

According to some embodiments of the volumetric strainmeter, a quantum-metered over-capacity valve is fluidly connected to the strain measurement chamber. In addition, the first and second fluid meters may each comprise a differential transformer connected to a capillary tube.

The invention provides another volumetric strainmeter comprising an outer housing, an inner housing insensitive to deformation due to tectonic stress, a first fluid disposed between the outer housing and the inner housing, a second fluid disposed in the inner housing, a first capillary tube fluidly connected to the first fluid, a second capillary tube fluidly connected to the second fluid, a first differential transformer connected to the first capillary tube, and a second differential transformer connected to the second capillary tube. The strainmeter may include an overcapacity metered relief valve fluidly connected to the first fluid and a plurality of partitions disposed between the outer housing and the inner housing. According to embodiments including partitions, the inner housing may be reinforced to resist strain due to transmitted forces. The strainmeter may include thermal conducting fins disposed inside the inner housing and extending to at least the inner housing, each of the plurality of thermally conducing fins comprising at least one hole permitting fluid passage therethrough. The thermal conducting fins may also absorb any forces transmitted by the outer housing.

Another aspect of the invention provides a method of reducing fluid expansion dependence comprising maintaining an internal dimension of a parameter measurement device and reducing an internal fluid volume of the measurement device by inserting a solid object into the measurement device to reduce thermal expansion of an interal fluid.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings identical reference numbers designate similar, but not necessarily identical elements.

DETAILED DESCRIPTION OF THE PREFERRED EMBODIMENTS

Figure 1:
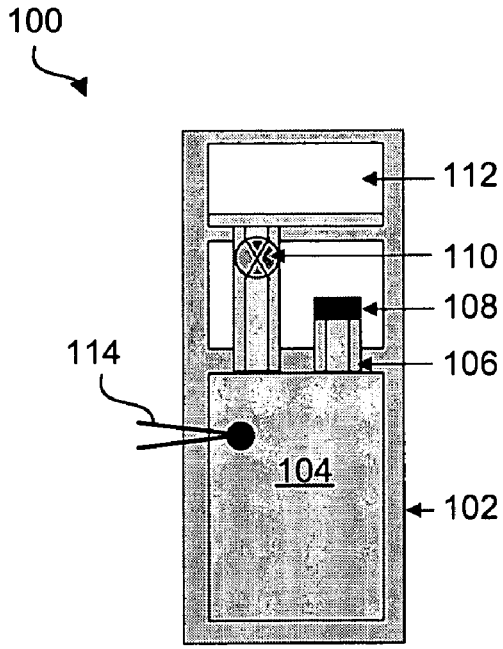
FIG. 1 is illustrates a single chamber volumetric strainmeter according to the prior art.

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

The present invention contemplates methods and apparatus for monitoring subterranean parameters such as stress or strain changes in the earth. Various methods and apparatus are contemplated for measuring the stress or strain while also compensating for temperature variations. Preferred embodiments of the methods and apparatus are described below, and may be particularly well suited to oilfield applications. However, the methods and apparatus presented herein are not so limited. The methods and systems may be applied to permanent and semi-permanent production, or other applications such as logging while drilling (LWD) and measurement while drilling (MWD). In a broader sense, the techniques described herein can be applied to any subterranean characterization measurements.

As used throughout the specification and claims, the term "fluid" means a continuous, amorphous substance whose molecules move freely past one another and that has the tendency to assume the shape of its container, including both liquids and gases. "Expansion" refers to an increase or decrease in size from an initial condition. A decrease in size would indicate a negative "expansion." "Solid" refers to a state of matter, something of definite shape, and does not necessarily mean something that is not hollow. "Reinforced" means strengthened, which may be done by structural arrangement, material selection, increased wall thicknesses, etc. The words "including" and "having," as used in the specification, including the claims, have the same meaning as the word "comprising."

The methods and systems presented herein for monitoring subterranean parameters include a description of at least two general principles. The at least two general principles include reducing temperature dependency, and compensating for temperature variations in volumetric strainmeters. The temperature compensation methods and apparatus are further categorized into systems using at least two different working fluids, and systems using a strain sensitive chamber and a strain-insensitive chamber.

As mentioned above in the background, subterraneous stress-strain measurements are most accurately detected with volumetric strainmeters. Nevertheless, volumetric strainmeters are dependent on temperature. Therefore, it is important to compensate for temperature variations or at least reduce temperature dependence to produce accurate stress or strain measurements. Stress and strain are proportional to one another in an elastic deformation range as a function of elastic constants. Therefore, hereafter, although the description may use the terms "strain" or "stress" individually, it will be understood that those of skill in the art having the benefit of this disclosure may be able to calculate stress from a strain measurement, or vice-versa.

Examples of thermal expansion coefficients of several different materials are listed below on Table 1. Generally, as shown in Table 1, thermal expansion coefficients of solids are usually smaller than thermal expansion coefficients of liquids by a factor of 10.

TABLE 1

Thermal Expansion Coefficients of Various Materials
Volumetric Thermal Expansion Coefficients of Materials

| Solid [$\times 10^{-6}$] | | Liquid [$\times 10^{-3}$] | |
|---|---|---|---|
| Aluminum | 69 | Water | 0.21 |
| Copper | 50 | Alcohol | 1.2 |
| Steel | 39 | Mercury | 0.18 |
| Inver | 2.7 | Glycerin | 0.51 |
| Glass | 27 | Benzol | 1.2 |
| Quartz glass | 1.5 | 21% Salt water | 0.41 |
| Ceramic | 9 | Acetone | 1.5 |
| Cement | 30~39 | Ether | 1.7 |
| Brick | 27 | Silicon oil | 0.95 |

Thermal expansion coefficients also vary considerably among the liquids. For example, the thermal expansion coefficient of water is about ⅕ of that for silicon oil. Accordingly, one way to reduce temperature dependency of volumetric strainmeters may be to replace the silicon oil with water as the working fluid. However, in order to reach the resolution desired for subterranean strain measurement, dependency on temperature needs to be reduced by orders of magnitude, which is not accomplished by a change in working fluid alone.

Equation (2) represents fluid volume change due to strain and Equation (3) represents the volume change due to temperature. From Equations (2) and (3) it follows that a reduction of the fluid volume—without reducing the diameter of the chamber—reduces temperature response of the strainmeter.

Figure 2:
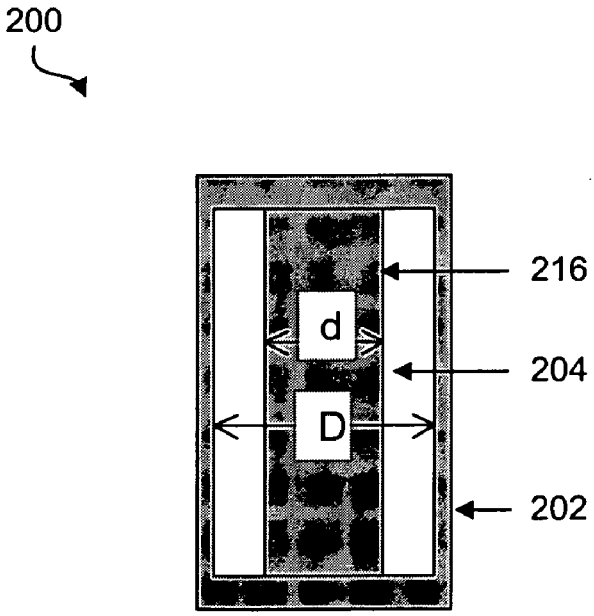
FIG. 2 is a cross sectional view of a an annulus strainmeter according to one embodiment of the present invention.

FIG. 2 illustrates an apparatus and method according to principles of the present invention to reduce temperature dependency. FIG. 2 illustrates a strainmeter 200 including a housing 202 with a first chamber such as cylindrical chamber 204 having a diameter D. The housing 202 may also contain the capillary tube 106 (FIG. 1), a fluid flow meter such as the differential transformer 108 (FIG. 1), the quantum-metered overcapacity relief valve 110 (FIG. 1), and the overcapacity chamber 112 (FIG. 1). However, unlike the strainmeter 100 of FIG. 1, a solid object such as a bar 216 of diameter d is placed inside the strainmeter 200.

As mentioned above and shown in Table 1, the thermal expansion coefficient of a solid is about 1/10 of that for fluid. Assuming that the tectonic stress changes the diameter of the strainmeter 200 from $D_1$ to $D_2$, the internal volume of the strainmeter is then changed from:

$$V_1 = \frac{\pi L}{4}(D_1^2 - d^2) \text{ to } V_2 = \frac{\pi L}{4}(D_2^2 - d^2) \tag{5}$$

The volume change due to tectonic stress, which is also the volume of fluid displaced from the cylindrical chamber 204 and measured by a flow meter, is therefore:

$$\Delta V = \frac{\pi L}{4}(D_2^2 - D_1^2) \tag{6}$$

Accordingly, the volume change is independent of the diameter of the solid inside.

However there will also be a volume change due to expansion of the fluid in the cylindrical chamber 204 in response to temperature variations. The volume change due to expansion of the fluid in the cylindrical chamber 204 without the bar 216 is:

$$\Delta V = \alpha \Delta T \frac{\pi L}{4} D^2 \tag{7}$$

On the other hand, the volume change due to temperature change with the bar 216 inserted into the cylindrical chamber 204 as shown in FIG. 2 is:

$$\Delta V = \alpha \Delta T \frac{\pi L}{4}(D^2 - d^2) \tag{8}$$

Therefore, volume change (and thus strain measurements) with the bar 216 inserted has less temperature dependency. Accordingly, by reducing the cylindrical chamber fluid volume (the annulus volume between the housing 202 and the bar 216), the temperature sensitivity of the strainmeter 200 is also significantly reduced.

Reducing temperature sensitivity may still not provide the level of accuracy desired for a volumetric stainmeter. It may be necessary to compensate for temperature expansion in addition to or alternative to reducing first chamber volume while maintaining first chamber diameter. One way to compensate temperature effects according to the present invention may be to use two different fluids, each having a different thermal expansion coefficient, in two separate chambers as shown in FIGS. 3A–3B.

Figure 3A:
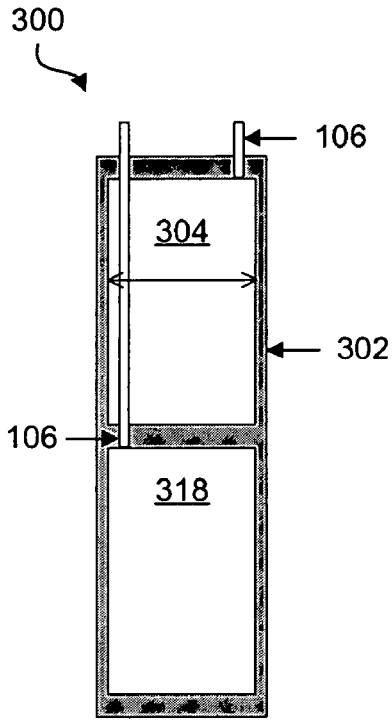
FIG. 3A is a cross sectional view of a dual chamber volumetric strainmeter according to one embodiment of the present invention.
Figure 3B:
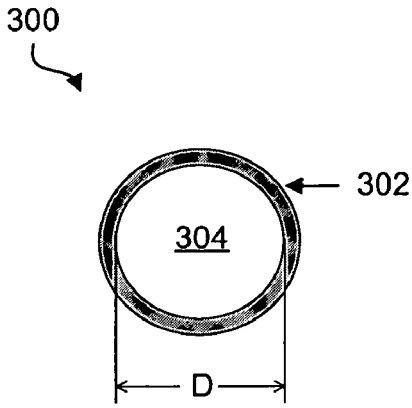
FIG. 3B is a top view of the dual chamber volumetric strainmeter of FIG. 3A.

FIGS. 3A–3B illustrate an apparatus and method according to principles of the present invention to measure subterranean strain, compensating for temperature variations. FIG. 3 illustrates a strainmeter 300 including a housing 302 with a first or strainmeter chamber 304 and a second or temperature compensation chamber 318. The housing 302 may also contain the capillary tube 106, first and second fluid flow meters such as the differential transformer 108 (FIG. 1), the quantum-metered overcapacity relief valve 110 (FIG. 1), and the overcapacity chamber 112 (FIG. 1). In fact both the strainmeter chamber 304 and the temperature compensation chamber 318 may be operatively connected to separate capillary tubes, fluid flow meters, quantum-metered overcapacity relief valves, and overcapacity chambers similar or identical to the arrangement shown in FIG. 1. As shown in FIG. 3B, the strainmeter chamber 304 and the temperature compensation chamber 318 may be cylindrical and stacked. The strainmeter chamber 304 and the temperature compensation chamber 318 are shown in FIGS. 3A–3B with identical shapes, sizes, and structures such that they strain in the same manner when subjected to the same stresses.

According to the embodiment of FIGS. 3A–3B, the strainmeter chamber 304 is filled with a first fluid having a first thermal expansion coefficient. The first fluid may include, but is not limited to: mercury, water, or glycerin. The temperature compensation chamber 318 is filled with a second fluid having a second thermal expansion coefficient. The second thermal expansion coefficient is greater than the first thermal expansion coefficient, preferably at least two to seven times greater than the first thermal expansion or more. Therefore, the second fluid is much more sensitive to temperature (i.e. the second fluid will expand much more than the first fluid for a given temperature change) than the first fluid. The second fluid may include, but is not limited to: ether, acetone, alcohol, benzol, or silicon oil. The volume change of the second fluid will likely be mostly due to temperature-induced expansion, and therefore act as a large, highly sensitive thermometer. The thermal expansion of the second fluid as it is displaced from the temperature compensation chamber 318 may be measured by a differential transformer in the same manner as the strainmeter shown in FIG. 1.

Assuming that the diameters of the strainmeter chamber 304 and the temperature compensation chamber 318 are each deformed from $D_1$ to $D_2$ due to tectonic stress change, and that the chamber lengths of each chamber are the same, the responses of the strainmeter chamber 304 and the temperature compensation chamber 318 may be written as:

$$\frac{\Delta V_1}{V} = \alpha_1 \Delta T + \left\{\left(\frac{D_2}{D_1}\right)^2 - 1\right\} \text{ and } \frac{\Delta V_2}{V} = \alpha_2 \Delta T + \left\{\left(\frac{D_2}{D_1}\right)^2 - 1\right\} \tag{9}$$

where $V_1$ represents the fluid volume of the strainmeter chamber 304 and $V_2$ represents the fluid volume of the temperature compensation chamber 318.

Therefore, the temperature change is:

$$\Delta T = \frac{(\Delta V_2 - \Delta V_1)}{V(\alpha_2 - \alpha_1)} \tag{10}$$

and the volumetric strain is found from:

$$\left\{\left(\frac{D_2}{D_1}\right)^2 - 1\right\} = \frac{\Delta V_1}{V} - \alpha_1 \frac{(\Delta V_2 - \Delta V_1)}{V(\alpha_2 - \alpha_1)} \tag{11}$$

which is independent of temperature and therefore compensated for temperature.

Figure 4:
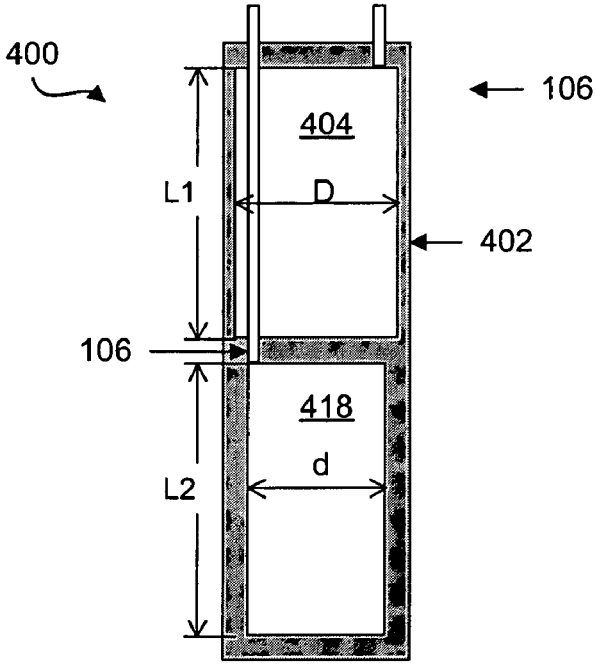
FIG. 4 is a cross sectional view of a dual chamber volumetric strainmeter according to another embodiment of the present invention.

Another way to eliminate temperature dependence is to measure stress and temperature using differences in stress responses and temperature responses. This may be done by using two chambers and the same working fluid. FIG. 4 illustrates a strainmeter 400 with two chambers: a strainmeter chamber 404 and a temperature compensation chamber 418, each filled with the same working fluid. Each of the strainmeter chamber 404 and the temperature compensation chamber 418 may also include the additional components shown in FIG. 1 (except for the thermocouple 114) for measuring volumes of fluid displaced from the chambers.

However, according to the embodiment of FIG. 4, the strainmeter chamber 404 is sensitive to strain and thus deforms in response to tectonic stress, and the temperature compensation chamber 418 is insensitive strain and does not deform in response to tectonic stress. The temperature compensation chamber 418 may be reinforced or otherwise strengthened such that it does not deform and displace fluid in response to stress levels anticipated by the environment in which the strainmeter 400 is placed. If the two chambers are designed to have the same volume of fluid as shown, then both the strainmeter chamber 404 and the temperature compensation chamber 418 will have the same response to temperature changes. Because the temperature chamber 418 is insensitive to strain and measures temperature only, the actual stress response is:

$$\text{Strain} = \underset{(Strain+Temperature)}{\text{Response of } \textit{Strainmeter} \text{ chamber}} - \underset{(Temperature)}{\text{Response of Temperature chamber}} \tag{12}$$

Therefore the total strain measurement is only a measure of the strain, not the fluid expansion due to temperature variations. Moreover, basing the temperature compensation on fluid expansion, a true average temperature compensation is made, rather than only a local temperature compensation available with a thermocouple.

It is also possible to use a different fluid with a higher thermal expansion coefficient in the temperature compensation chamber 418. Using a fluid having a higher thermal expansion coefficient may provide a higher temperature response or the same temperature response with a reduced volume. By designing the strainmeter chamber 404 with a larger volume for the reduced size temperature compensation chamber 418, the stress measurement sensitivity is improved.

Figure 5:
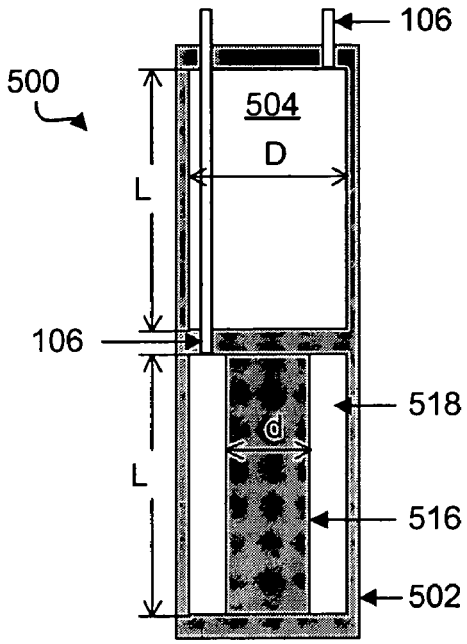
FIG. 5 is a cross sectional view of a dual chamber volumetric strainmeter with an internal object included in one of the chambers according to another embodiment of the present invention.

Another method and apparatus that may be used to enhance strain measurement may include use of different volume chambers. FIG. 5 illustrates a strainmeter 500 with a housing 502 and first and second strain measurement chambers 504, 518. As with previous embodiments, each of the strain measurement chambers 504, 518 preferably includes the capillary tube 106 (FIG. 1), a fluid flow meter such as the differential transformer 108 (FIG. 1), the quantum-metered overcapacity relief valve 110 (FIG. 1), and the overcapacity chamber 112 (FIG. 1). FIG. 5 also illustrates insertion of an inner solid bar 516 into the second measurement chamber 518 to reduce the amount of fluid inside the second chamber 518. Therefore, the first strain measurement chamber 504 responds to strain and temperature while the second strain measurement chamber 518 responds to strain and a fraction of temperature. Assuming, for example, that the fluid volume capacity of the second measurement chamber 518 is 1/10 of the fluid volume capacity of the first measurement chamber 504. The responses of the chambers are:

$$\text{Second chamber}=\text{Strain}+\tfrac{1}{10}*\text{Temperature} \quad (13)$$

$$\text{First chamber}=\text{Strain}+\text{Temperature} \quad (14)$$

Then, $$\text{Strain}=\tfrac{10}{9}*\text{Second chamber}-\tfrac{1}{9}*\text{First chamber} \quad (15)$$

It is also possible to use a relatively low thermal expansion fluid in the first chamber 504 and a relatively high thermal expansion fluid in the second chamber 518 to improve strain response with a larger size first chamber 504 and a reduced size second chamber 518.

Figure 6:
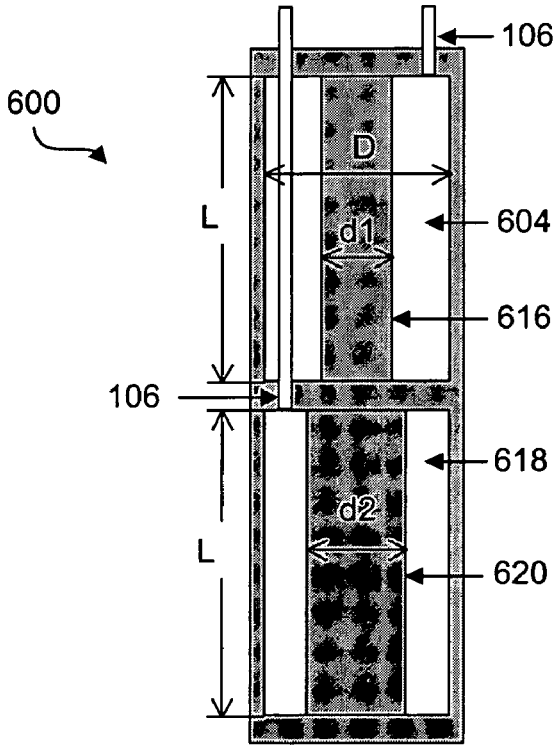
FIG. 6 is a cross sectional view of a dual chamber volumetric strainmeter with a internal objects included in both of the chambers according to another embodiment of the present invention.

Two chambers 604, 618 are designed with different size rods 616, 620, respectively, according to the embodiment of a strainmeter 600 shown in FIG. 6. Assuming, for example, that the volume of the first chamber 604 is reduced to 20% of normal capacity (fluid capacity without the first rod 616) and that of Chamber 2 is reduced to 10% of normal capacity, then the responses of each chamber may be written as:

$$\text{First chamber}=\text{Strain}+0.2*\text{Temperature} \quad (16)$$

$$\text{Second chamber}=\text{Strain}+0.1*\text{Temperature} \quad (17)$$

Then, $$\text{Strain}=2*\text{Second chamber}-\text{First chamber} \quad (18)$$

The fractions of 0.1 and 0.2 are used just for example. Moreover, the lengths L of the two chambers 604, 618 and the fluids contained in the two chambers 604, 618 may be different. It will of course be appreciated that each chamber 604, 618 of the embodiment of FIG. 6 will preferably include the components of FIG. 1 (except for the thermocouple).

The subtraction of temperature expansion effect for the embodiment shown in FIG. 5 is large and the resulting stress is small. Accordingly, small errors in temperature measurement may cause errors in estimating stress. According to the embodiment of FIG. 6, the temperature effects are reduced by reducing the fluid volume. The stress is obtained by canceling small temperature effects and any error should be small.

The embodiments described above with reference to FIGS. 4–6 disclose stacked multi-chamber arrangements. Therefore, temperature and strain are measured at slightly different depths or positions along the strainmeters. If, for example, one of the strainmeters 400/500/600 is long, the stress and temperatures at the different positions may be slightly different. Ideally, temperature and strain would be measured at the same depth or position to avoid any uncertainty errors.

Figure 7:
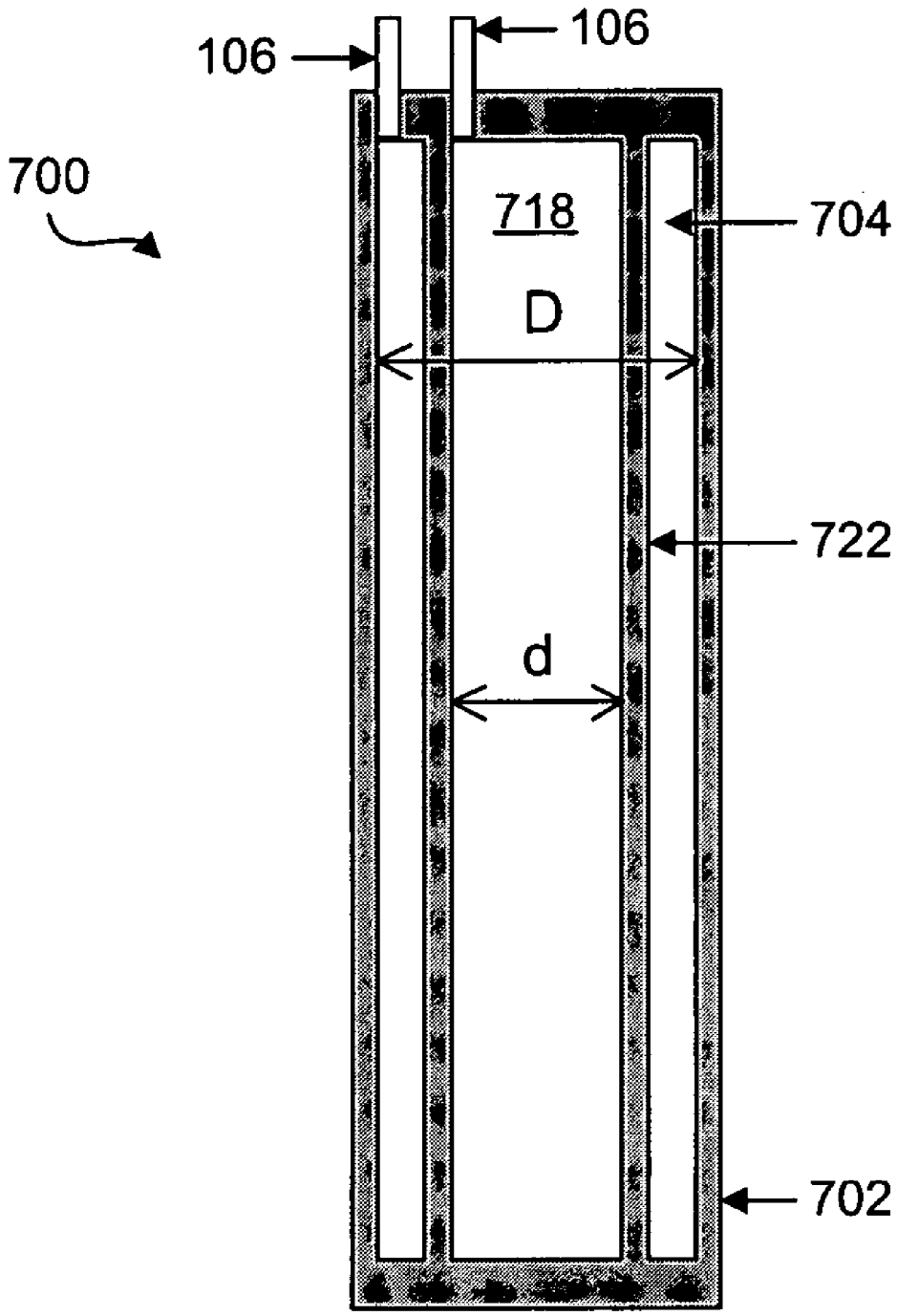
FIG. 7 is a cross sectional view of a dual concentric chamber volumetric strainmeter according to another embodiment of the present invention.

FIG. 7 illustrates a strainmeter 700 with a temperature compensation chamber disposed inside the strainmeter. The strainmeter 700 of FIG. 7 includes an outer housing 702, an inner housing 722, and an annulus formed between the inner housing 722 and the outer housing 702. The annulus comprises a first or strain measurement chamber 704, and the inner housing 722 defines a second or temperature compensation chamber 718. According to the embodiment of FIG. 7, the second chamber 718 is interior with respect to the first chamber 704. The second chamber 718 is preferably concentric or eccentric with respect to the first chamber 704. It will again be appreciated that each chamber 704, 718 of the embodiment of FIG. 7 will preferably include the components of FIG. 1 (except for the thermocouple).

The annulus or first chamber 704 is filled with a first fluid having a first thermal expansion coefficient, preferably a fluid such as mercury or water having a reduced temperature response. The outer housing 702 is sensitive to strain, and therefore tectonic stress deforms the outer housing 702 and displaces a measurable volume of the first fluid in the first chamber.

The second chamber 718 contains a second fluid. The outer housing 702 sustains all the tectonic stress by deformation. The fluid in the annulus or first chamber 704 is squeezed, but there is no substantial pressure change in the first fluid as a result of tectonic stress. The inner housing 722 does not sustain any of the tectonic stress unless there are ribs or partitions mechanically connected between outer housing 702 and inner housing 722. The second chamber 718 is sensitive to temperature only. Moreover, the fluid volume in the first chamber 704 is reduced as a result of the presence of concentric inner housing 722, and therefore, the temperature expansion effect of the first fluid is small. The second fluid has a second thermal expansion coefficient that is preferably highly sensitive to temperature variations. The second fluid may comprise ether, acetone or other liquids such that the volume displaced from the second chamber is dominated by changes in temperature. The low temperature dependency of the first fluid in the first chamber 704 is further compensated by the temperature response of the second fluid contained in the second chamber.

If an internal diameter of the outer housing 702 deforms from $D_1$ to $D_2$, the observed change in fluid volume displaced, $\Delta V_1$ is the sum of the thermal expansion of the first fluid and internal volume change of the first chamber 704. $\Delta V_2$ is the displaced volume of the second fluid from the second chamber 718 due to thermal expansion of the second fluid. The internal diameter of the second chamber 718 is shown as d. Accordingly:

$$\Delta V_1 = \alpha\Delta T\frac{\pi L}{4}(D_1^2 - d^2) + \frac{\pi L}{4}(D_2^2 - D_1^2) \quad (19)$$

$$\Delta V_2 = \alpha\Delta T\frac{\pi L}{4}d^2 \quad (20)$$

And the volumetric strain is:

$$\frac{\pi L}{4}(D_2^2 - D_1^2) = \Delta V_1 - \Delta V_2\left(\frac{D_1^2}{d^2} - 1\right) \quad (21)$$

which is independent of temperature or compensated for temperature.

Figure 8:
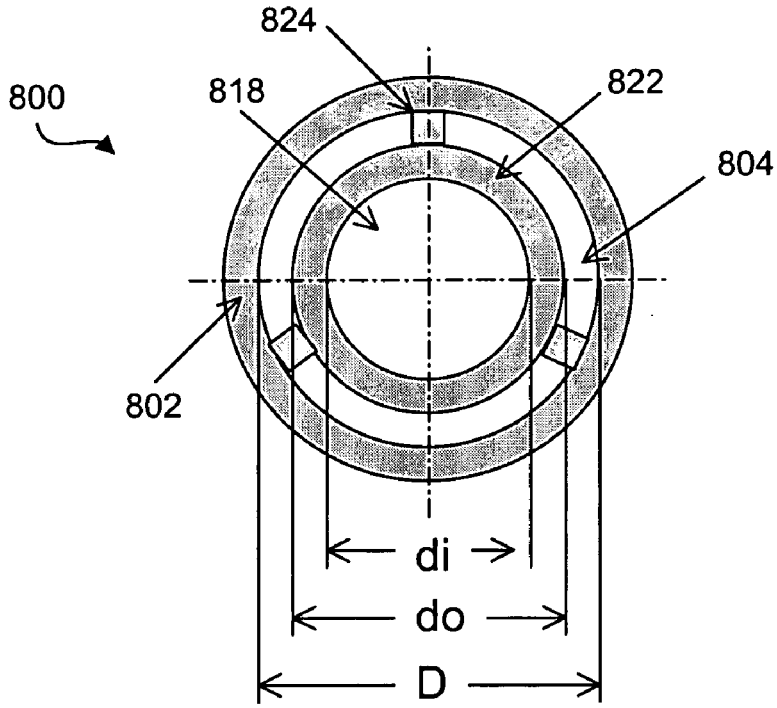
FIG. 8 is a top view of a dual concentric chamber volumetric strainmeter with partitions to measure direction of tectonic strain according to another embodiment of the present invention.

FIG. 8 illustrates, according to one embodiment, a top view of a dual concentric chamber strainmeter 800 similar or identical to the strainmeter 700 shown in FIG. 7. As shown in FIG. 8, an annulus defining an outer chamber 804 between an inner housing 822 and an outer housing 802 may be divided into multiple rooms by three or more partitions 824. The multiple partitions 824 enable directional measurement of tectonic stress.

Each partitioned segment of the outer chamber 804 is preferably filled with a first fluid having a relatively low thermal expansion coefficient, such as mercury or water. An inner chamber 818 is reinforced or strengthened so that it does not deform due to external stress transmitted by the partitions 824 and maintains a constant internal volume. The inner chamber 818 is filled with a second fluid that is preferably highly sensitive to temperature, such as ether or acetone, so that any volume of fluid displaced from the inner chamber 818 is dominated by temperature change (thermal expansion of the second fluid).

Figure 9:
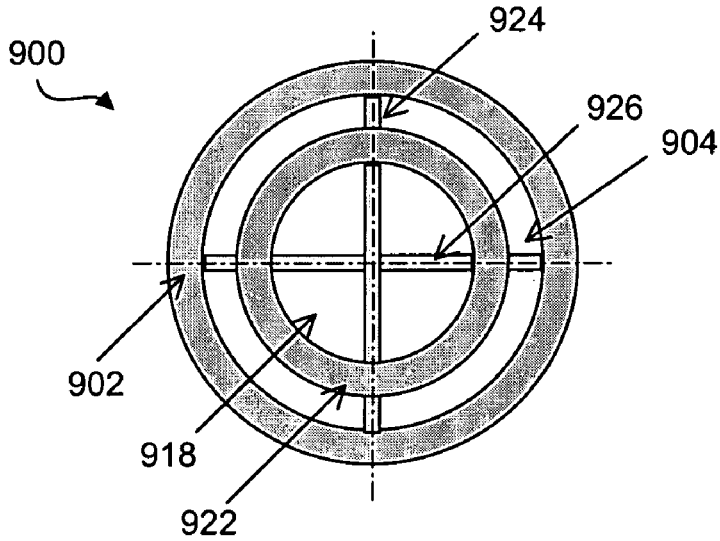
FIG. 9 is a top view of a dual concentric chamber volumetric strainmeter with partitions and thermal fins according to another embodiment of the present invention.

FIG. 9 illustrates a top view of a dual concentric chamber strainmeter 900 according to another embodiment similar or identical to the strainmeter 700 shown in FIG. 7. The strainmeter 900 of FIG. 9 is a multi-component strainmeter wherein an outer chamber 904 bounded by an inner housing 922 and an outer housing 902 is sectioned into four sub-chambers by four partitions 924. In addition, the strainmeter 900 includes thermal conduction fins 926 installed in a reinforced inner chamber 918 and extending to at least the inner housing 922 for more efficient heat transfer from the outer chamber 904 to the inner chamber 918. The thermal conduction fins 926 may each include one or more holes to allow fluid communication throughout the inner chamber 918. Any temperature changes in a subterranean formation into which the strainmeter 900 is inserted will be conducted to the first fluid in the outer chamber 904. Heat is then quickly conducted from the outer chamber 904 to the inner chamber 918 by the thermal conduction fins 926. The thermal conduction fins 926 improve the delay in reaching thermal equilibrium between the inner and outer chambers 904, 918 by improving the thermal conduction therebetween.

The strain measurement methods and apparatus described above to reduce temperature dependence and/or compensate for temperature variations are exemplary in nature. The preferred embodiments and aspects have been disclosed to teach the principles of the present invention, which include subterranean strain measurements that are compensated for temperature without a thermocouple and are instead corrected by measuring fluid expansion. It will be understood by those of skill in the art having the benefit of this disclosure that many variations in structure and implementation may be made to suit particular purposes. Nevertheless, any method or apparatus measuring subterranean and reducing temperature dependence by reducing strainmeter volume or temperature compensation based on the principles of fluid expansion are contemplated by the invention.

Therefore, the preceding description has been presented only to illustrate and describe the invention. It is not intended to be exhaustive or to limit the invention to any precise form disclosed. Many modifications and variations are possible in light of the above teaching.

The preferred embodiments were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

It should be noted that the fluid confined in stress reinforced chambers is insensitive to strain and sensitive to temperature. This is indeed a very high resolution thermometer. This thermometer is useful not only to compensate strainmeter but also for other temperature dependent sensors.

The outer housing of concentric or eccentric chambers prevents transmission of stress to inner housings, yet fluid still transmits heat from outer housing to inner housing.

It will also be understood by those of skill in the art having the benefit of this disclosure that the apparatus described above may also used to measure temperature, compensating for strain, rather than measuring strain and compensating for temperature. Accordingly, some methods according to principles of the present invention include measuring temperature changes in the earth using fluid expansion to compensate for strain variations.

What is claimed is:

1. A method of monitoring subterranean parameters comprising:

measuring fluid volume change of a first fluid in response to stress or strain, the first fluid comprising a first thermal expansion coefficient;

measuring fluid volume change of a second fluid comprising a second thermal expansion coefficient;

compensating the fluid volume change measurement of the first fluid for temperature using the fluid volume change measurement of the second fluid, wherein the second thermal expansion coefficient is greater than the first thermal expansion coefficient.

2. A method of monitoring subterranean parameters according to claim 1, wherein the second thermal expansion coefficient is at least two times greater than the first thermal expansion coefficient.

3. A method of monitoring subterranean parameters according to claim 1, wherein the second thermal expansion coefficient is at least five times greater than the first thermal expansion coefficient.

4. A method of monitoring subterranean parameters according to claim 1, wherein the second thermal expansion coefficient is at least seven times greater than the first thermal expansion coefficient.

5. A method of monitoring subterranean parameters according to claim 1, wherein the first fluid is selected from the group consisting of: water, mercury, and glycerin; and the second fluid is selected from the group consisting of: alcohol, benzol, acetone, ether, and silicon oil.

6. A method of monitoring subterranean parameters according to claim 1, further comprising using fluid expansion of the second fluid in response to temperature changes to compensate for true average temperature variations.

7. A method of monitoring subterranean parameters according to claim 1, wherein stress or strain comprise tectonic stresses.

8. A method of monitoring subterranean parameters according to claim 1, further comprising:

filling a first chamber of a volumetric strainmeter with the first fluid comprising the first thermal expansion coefficient;

filling a second chamber of the volumetric strainmeter with the second fluid comprising the second thermal expansion coefficient;

measuring a volume of fluid displaced from the first chamber in response to stress or strain;

measuring fluid expansion of the second fluid due to temperature variations;

compensating the measurement of first fluid displaced from the first chamber for the temperature variations.

9. A method of monitoring subterranean parameters according to claim 8, wherein the second fluid comprises a larger thermal expansion coefficient than the first fluid.

10. A method of monitoring subterranean parameters according to claim 8, wherein the second fluid comprises a thermal expansion coefficient at least five times larger than the first fluid.

11. A method of monitoring subterranean parameters comprising:

providing a first fluid chamber sensitive to strain or stress, the first fluid chamber comprising a first volume of fluid;

providing a second fluid chamber insensitive to strain or stress, the second fluid chamber comprising a second volume of fluid;

measuring fluid displaced from the first fluid chamber in response to strain or stress;

measuring expansion of the second volume of fluid in response to temperature variations;

compensating measured fluid displaced from the first fluid chamber for temperature by the measured expansion of the second volume of fluid.

12. A method of monitoring subterranean parameters according to claim 11, wherein the fluid in the first and second fluid chambers is the same.

13. A method of monitoring subterranean parameters according to claim 11, wherein the fluid in the first fluid chamber has a lower thermal expansion coefficient than the fluid in the second fluid chamber.

14. A method of monitoring subterranean parameters according to claim 10, further comprising:

providing the second fluid chamber concentric with the first fluid chamber;

measuring displacement of the first volume of fluid from the first fluid chamber in response to strain or stress and in response to temperature changes;

measuring displacement of the second volume of fluid from the second fluid chamber in response to temperature changes;

compensating strain or stress measurements for temperature using the measured displacement of the second volume of fluid due to temperature changes.

15. A method of monitoring subterranean parameters according to claim 14, wherein the first volume is defined by an annulus between first and second chambers.

16. A method of monitoring subterranean parameters comprising:

providing a first fluid chamber of a first exterior size sensitive to strain or stress and having a first volume of fluid;

providing a second fluid chamber of the first exterior size sensitive to strain or stress and having a second volume of fluid, the second volume of fluid being less than the first volume of fluid;

measuring displacement of the first volume of fluid from the first chamber in response to strain or stress and in response to temperature changes;

measuring displacement of the second volume of fluid from the second chamber in response to strain or stress and in response to a fraction of the temperature changes;

compensating strain or stress measurements for temperature using the fractional displacement change due to temperature changes in the second chamber.

17. A method of monitoring subterranean parameters according to claim 16, further comprising:

reducing the first volume of fluid by inserting a first object into the first chamber;

reducing the second volume of fluid by inserting a second object into the second chamber.

18. A method of measuring subterranean stress or strain comprising:

filling a first chamber of a volumetric strainmeter with a first fluid;

filling a second chamber of the volumetric strainmeter with a second fluid;

measuring a volume of fluid displaced from the first chamber in response to stress or strain;

measuring fluid expansion of the second fluid due to temperature variations;

compensating the measurement of first fluid displaced from the first chamber for the temperature variations, wherein the first chamber comprises a strain-sensitive chamber and the second chamber comprises a strain-insensitive chamber.

19. A method of measuring subterranean stress or strain according to claim 18, wherein the first and second fluid comprise the same fluid.

20. A method of monitoring subterranean parameters comprising:

measuring changes in volumetric fluid capacity of a first chamber containing a first fluid in response to tectonic stresses and temperature variations, the first fluid comprising a first thermal expansion coefficient;

measuring changes in volumetric fluid capacity of a second chamber containing a second fluid in response to tectonic stresses and temperature variations, the second fluid comprising a second thermal expansion coefficient, the second thermal expansion coefficient being different than the first thermal expansion coefficient;

calculating volumetric strain independent of temperature.

21. A method of monitoring subterranean parameters comprising:

measuring changes in volumetric fluid capacity of a first chamber containing a first fluid in response to tectonic stresses and temperature variations, the first chamber being sensitive to strain;

measuring changes in volumetric fluid capacity of a second chamber containing a second fluid in response to temperature variations only, the second chamber being insensitive to strain;

calculating volumetric strain compensated for temperature by subtracting the measured changes in volumetric fluid capacity of the second chamber from the measured changes in volumetric fluid capacity of the first chamber.

22. A volumetric strainmeter, comprising:

a housing;

a strain measurement chamber filled with a first fluid;

a temperature compensation chamber filled with a second fluid;

a first fluid meter operatively connected to the strain measurement chamber for measuring fluid displaced from the strain measurement chamber;

a second fluid meter operatively connected to the temperature compensation chamber for measuring fluid displaced from the temperature compensation chamber, wherein the strain measurement chamber deforms in response to stress or strain in the earth, and the temperature compensation chamber does not deform in response to stress or strain in the earth.

23. A volumetric strainmeter according to claim 22, wherein the first and second fluids comprise the same thermal expansion coefficient.

24. A volumetric strainmeter according to claim 22, wherein the temperature compensation chamber is concentric or eccentric with the strain measurement chamber.

25. A volumetric strainmeter according to claim 24, wherein the temperature compensation chamber is arranged inside the housing, and the strain measurement chamber comprises an annulus between the housing and the temperature compensation chamber.

26. A volumetric strainmeter according to claim 25, wherein the strain measurement chamber is partitioned.

27. A volumetric strainmeter according to claim 24, further comprising a plurality of thermal conduction fins extending from the temperature compensation chamber to the strain measurement chamber.

28. A volumetric strainmeter according to claim 22, wherein the first and second fluid meters each comprise a differential transformer connected to a capillary tube.

29. A volumetric strainmeter comprising:

a housing;

a strain measurement chamber filled with a first fluid;

a temperature compensation chamber filled with a second fluid;

a first fluid meter operatively connected to the strain measurement chamber for measuring fluid displaced from the strain measurement chamber;

a second fluid meter operatively connected to the temperature compensation chamber for measuring fluid displaced from the temperature compensation chamber, wherein the strain measurement chamber and the temperature compensation chamber deform substantially identically in response to stress or strain in the earth, and wherein the first and second fluids have different, known thermal expansion coefficients.

30. A volumetric strainmeter according to claim 29, wherein at least one of the strain measurement chamber and the temperature compensation chamber includes a solid object, wherein a fluid annulus is defined between the solid object and the housing.

31. A volumetric strainmeter according to claim 30, wherein the strain measurement chamber includes the solid object, the solid object having a first diameter, and the temperature compensation chamber includes a second solid object having a second diameter different from the first diameter.

32. A volumetric strainmeter comprising:

a housing;

a strain measurement chamber filled with a first fluid;

a temperature compensation chamber filled with a second fluid;

a first fluid meter operatively connected to the strain measurement chamber for measuring fluid displaced from the strain measurement chamber;

a second fluid meter operatively connected to the temperature compensation chamber for measuring fluid displaced from the temperature compensation chamber;

a quantum-metered overcapacity valve operatively connected to the strain measurement chamber.

33. A volumetric strainmeter, comprising: an outer housing;

a reinforced inner housing resistant to deformation due to stress or strain in the earth;

a first fluid disposed between the outer housing and the reinforced inner housing;

a second fluid disposed in the reinforced inner housing;

a first capillary tube fluidly connected to the first fluid;

a second capillary tube fluidly connected to the second fluid;

a first differential transformer connected to the first capillary tube;

a second differential transformer connected to the second capillary tube.

34. A volumetric strainmeter according to claim 33, further comprising an overcapacity metered relief valve fluidly connected to the first fluid.

35. A volumetric strainmeter according to claim 33, wherein the second fluid comprises a thermal expansion coefficient at least twice as large as the first fluid.

36. A volumetric strainmeter according to claim 33, wherein the second fluid comprises a thermal expansion coefficient at least five times as large as the first fluid.

37. A volumetric strainmeter according to claim 33, further comprising a plurality of partitions disposed between the outer housing and the reinforced inner housing.

38. A volumetric strainmeter according to claim 33, further comprising thermal conducting fins disposed inside the reinforced inner housing and extending to at least the inner housing, each of the plurality of thermally conducing fins comprising at least one hole permitting fluid passage therethrough.

39. A method of monitoring subterranean parameters comprising measuring changes in subterranean temperature using fluid expansion of two fluids to compensate for strain variations, the method further comprising:

measuring fluid volume change of a first fluid in response to temperature changes, the first fluid comprising a first thermal expansion coefficient;

measuring fluid volume change of a second fluid in response to strain, the second fluid having a second thermal expansion coefficient, the second thermal expansion coefficient being less than the first thermal expansion coefficient;

compensating the fluid volume change measurement of the first fluid for strain using the fluid volume change measurement of the second fluid.

* * * * *